US008939086B2

(12) United States Patent
Müller et al.

(10) Patent No.: US 8,939,086 B2
(45) Date of Patent: Jan. 27, 2015

(54) RUNNING GEAR FOR A RAIL VEHICLE WITH A TRANSVERSALLY DECOUPLING MOTOR SUSPENSION

(75) Inventors: Detlef Müller, Siegen (DE); Matthias Kwitniewski, Aachen (DE); Igor Geiger, Kreuztal (DE); Paul Gier, Aachen (DE); Heiko Mannsbarth, Wiesbaden (DE)

(73) Assignee: Bombardier Transportation GmbH, Berlin (DE)

( * ) Notice: Subject to any disclaimer, the term of this patent is extended or adjusted under 35 U.S.C. 154(b) by 284 days.

(21) Appl. No.: 13/416,601

(22) Filed: Mar. 9, 2012

(65) Prior Publication Data

US 2012/0260817 A1 Oct. 18, 2012

(30) Foreign Application Priority Data

Mar. 16, 2011 (EP) ..... 11158514

(51) Int. Cl.
*B61C 1/00* (2006.01)
*B61C 9/50* (2006.01)
*B61F 3/04* (2006.01)

(52) U.S. Cl.
CPC .... *B61C 9/50* (2013.01); *B61F 3/04* (2013.01)
USPC ..... 105/133

(58) Field of Classification Search
CPC ..... B61C 3/00; B61C 3/02; B61C 11/00; B61C 11/005; B61C 17/00; B61C 17/10; B61F 3/00; B61F 3/04; B61F 5/00; B61F 5/02; B61F 5/04; B61F 5/26; B61F 5/50
USPC ..... 105/34.1, 34.2, 96, 133, 157.1, 182.1, 105/184
See application file for complete search history.

(56) References Cited

U.S. PATENT DOCUMENTS

| | | | | | |
|---|---|---|---|---|---|
| 3,523,505 | A * | 8/1970 | Lich | ..... | 105/198.7 |
| 3,538,856 | A * | 11/1970 | Lich | ..... | 105/198.7 |
| 3,817,188 | A * | 6/1974 | Lich | ..... | 105/199.3 |
| 4,526,107 | A * | 7/1985 | Mautner et al. | ..... | 105/133 |
| 4,787,318 | A * | 11/1988 | Vogel | ..... | 105/136 |
| 5,181,473 | A * | 1/1993 | Petit et al. | ..... | 105/133 |
| 2010/0116167 | A1 | 5/2010 | Korner | | |
| 2010/0307371 | A1 * | 12/2010 | Rodet | ..... | 105/133 |

* cited by examiner

*Primary Examiner* — R. J. McCarry, Jr.
(74) *Attorney, Agent, or Firm* — The Webb Law Firm

(57) ABSTRACT

A running gear for a rail vehicle, including a wheel unit, a motor unit and a running gear frame unit being supported on the wheel unit. The motor unit is connected to the wheel unit to drive the wheel unit. Further more, the motor unit is suspended to the running gear frame unit via a connecting device. The connecting device is transversally elastic to allow a relative transverse motion between the motor unit and the running gear frame unit. The connecting device has a transverse rigidity being sufficiently low such that a contribution of the motor unit to an inertial moment of the running gear frame unit about the height direction is reduced by at least 50%.

15 Claims, 2 Drawing Sheets

RUNNING GEAR FOR A RAIL VEHICLE WITH A TRANSVERSALLY DECOUPLING MOTOR SUSPENSION

BACKGROUND OF THE INVENTION

The present invention relates to a running gear for a rail vehicle, comprising a wheel unit, a motor unit and a running gear frame unit. The running gear frame unit defines a longitudinal direction, a transverse direction and a height direction, and is supported on the wheel unit, while the motor unit is connected to the wheel unit to drive the wheel unit. The motor unit is suspended to the running gear frame unit via a connecting device. The present invention further relates to a rail vehicle comprising such a running gear.

In modern rail vehicles, in particular, modern high-speed rail vehicles, two basically different approaches may be taken to suspend the electric drive motors within the running gear. A first approach is to suspend the motor primarily to the axle of the wheel unit (such as e.g. a wheel set or a wheel pair) as it is known, for example, from US 2010/0116167 A1 (Körner). The connection to the running gear frame typically via one or more elastically connected pendulums of a torque support serving to support the drive torque of the motor. Such a solution may have the advantage that within the drive train from the motor shaft to the wheel set shaft, relative motion affecting proper tooth engagement may be largely avoided. However, this approach has the disadvantage that the mass of the motor to a large extent contributes to the so-called unsprung or non-suspended mass of the running gear, i.e. the mass of the running gear which is not suspended via at least one (primary or secondary) spring system. In particular for high-speed applications, such a high unsprung mass is undesirable in terms of the dynamic and acoustic properties of the running gear.

A different approach, as is known, for example, from JP 62016036 A (Ando et al.), substantially rigidly suspends the motor to the running gear frame. While this approach reduces the unsprung mass, it has the disadvantage that the inertia of the running gear frame unit, in particular, the inertial moment about the height axis, is increased due to the additional mass of the motor. Such a high inertial moment also has certain dynamic disadvantages in terms of the running stability of the running gear, in particular and high speeds.

SUMMARY OF THE INVENTION

It is thus an object of the present invention to provide a running gear as outlined above that, at least to some extent, overcomes the above disadvantages. It is a further object of the present invention to provide a running gear that provides improved dynamic properties.

The above objects are achieved starting from a running gear according to the preamble of claim 1 by the features of the characterizing part of claim 1.

The present invention is based on the technical teaching that improvement of the dynamic behavior of the running gear, in particular, at high speeds, maybe achieved if the motor unit is suspended to the running gear frame unit via a connecting device which, at least over a certain deflection in the transverse direction, largely elastically decouples the motor unit from the running gear frame unit.

This configuration has the advantage that, on the one hand, due to the suspension of the motor unit to the running gear frame, the motor unit forms part of the sprung mass. This provides all the dynamic and acoustic advantages of a reduced unsprung mass.

At the same time, decoupling the motor unit from the running gear frame unit in the transverse direction has the advantage that, over a certain transverse deflection, the mass of the motor unit, if at all noticeable, only contributes to the inertial moment of the running gear frame unit to a highly reduced extent. This is highly beneficial in terms of the running stability of the running gear, especially at high speeds, which is considerably improved due to a low inertial moment about the running gear's yaw axis (i.e. the height axis of the running gear).

Hence, according to one aspect, the present invention relates to a running gear for a rail vehicle, comprising a wheel unit, a motor unit and a running gear frame unit. The running gear frame unit defines a longitudinal direction, a transverse direction and a height direction. Furthermore, the running gear frame unit is supported on the wheel unit. The motor unit, on the one hand, is connected to the wheel unit to drive the wheel unit. On the other hand, the motor unit is suspended to the running gear frame unit via a connecting device. The connecting device is transversally elastic (i.e. elastic in the transverse direction) to allow, from a transversally undeflected state of the connecting device, a relative transverse motion in the transverse direction between the motor unit and the running gear frame unit. The connecting device has a defined transverse rigidity in the transverse direction, the transverse rigidity, in the transversally undeflected state, being sufficiently low such that, compared to a substantially transversally rigid mounting of the motor unit to the running gear frame unit, a contribution of the motor unit to an inertial moment of the running gear frame unit about the height direction is reduced by at least 50%, preferably by at least 75%, more preferably by at least 90%.

It will be appreciated that the decoupling effect of the connecting device may be limited to a certain deflection of the connecting device in the transverse direction. Furthermore, the degree of decoupling does not necessarily have to be constant over this deflection. For example, starting from the neutral position (i.e. the transversally undeflected state), inertial decoupling may decrease with increasing deflection in the transverse direction. It is only crucial that, over the range of deflection to be expected during normal operation of the running gear, sufficient inertial decoupling, i.e. a sufficient reduction in the contribution of the motor unit to the inertial moment is achieved. Hence, the decoupling properties of the connecting device, in particular, the characteristic line of the transverse rigidity of the connecting device, may be easily adjusted as a function of the specific kinematics of the running gear, its mass distribution, in particular the mass of the motor, and the loads to be expected during normal operation of the running gear.

The amount of decoupling may be chosen according to the dynamic requirements of the respective running gear at its normal or nominal operating speed. Especially beneficial effects on the dynamic properties of the running gear, in particular at very high nominal operating speeds (in particular beyond 250 km/h) are achieved if the transverse rigidity, in the transversally undeflected state, is sufficiently low such that an inertial transverse force resulting from a given acceleration of the motor unit in the transverse direction and introduced via the connecting device into the running gear frame unit is less than 50% of a reference transverse force, preferably less than 25% of a reference transverse force, more preferably less than 10% of a reference transverse force. Here, the reference transverse force is an inertial transverse force resulting, in a reference state, from the above given acceleration of the motor unit in the transverse direction and introduced via a reference connecting device into the running gear frame unit, the reference connecting device, in the reference state, replacing the connecting device and being substantially rigid to substantially prevent the relative transverse motion.

The desired transverse decoupling as it has been outlined above may be achieved by any suitable decoupling means, the specifics of the respective decoupling means greatly depending on the specific properties of the respective running gear. More precisely, the transverse rigidity of the decoupling means, generally, depends on the mass of the motor, the desired range of deflection of the motor and on the vibration excitation to be expected during operation of the running gear. The size of the motor greatly depends on the design and the application of the vehicle. In high-speed rail vehicles with a distributed traction equipment, typically, motors having a mass in the range from 400 kg to 550 kg are used. According to the present invention, a range of deflection from 5 mm to 15 mm is preferred. Hence, typically, particularly advantageous decoupling properties are achieved if the transverse rigidity of the connecting device, in the transversally undeflected state, is less than 0.32 kN/mm, preferably less than 0.28 kN/mm, more preferably 0.20 kN/mm to 0.25 kN/mm.

Furthermore, in addition or as an alternative, the characteristics of the transverse rigidity may be tuned to the specifics of the respective running gear. For example, it may be desired to reduce the decoupling effect with increasing transverse deflection of the connecting device. Hence, with preferred embodiments of the invention, the transverse rigidity, from the transversally undeflected state, follows a characteristic line, the characteristic line, in particular progressively, rising with increasing deflection. However, with other embodiments of the invention, in the other desired course of the characteristic line of the transverse rigidity may be chosen. In particular, this may also include sections of the characteristic line where the transverse rigidity is decreasing with increasing transverse deflection.

It will be appreciated that the transverse rigidity may exclusively be a function of the transverse deflection of the connecting device. However, with preferred embodiments of the invention, highly beneficial effects may be achieved if the transverse rigidity and, hence, the decoupling properties is/are a function of further, variables and/or parameters of the system.

Particularly beneficial effects may be achieved if the transverse rigidity of the connecting device is a function of the frequency of the loads acting and, hence, a function of the frequency of the transverse excursion occurring. Hence, preferably, the connecting device has a frequency dependent behavior, the transverse rigidity being present at a frequency of the relative transverse motion above 1 Hz, preferably from 1 Hz to 15 Hz, more preferably from 3 Hz to 10 Hz.

In any case, preferably, increased decoupling at high frequencies and/or small deflections is provided to achieve particularly beneficial effects at high operating speeds.

It will be appreciated about the connecting device may have any suitable design providing the above decoupling properties. Particularly simple and economic configurations are achieved if the connecting device comprises at least one connecting element, the connecting element comprising a laminated element made from a sequence of elastic layers and substantially rigid layers, the layers, in the transversally undeflected state, extending substantially parallel to the transverse direction. Such laminated elements are of particularly simple and robust design and may be easily tuned to the desired decoupling properties.

With particularly simple and advantageous designs, the connecting element defines a connecting element axis, the connecting element axis, in the transversally undeflected state, extending substantially parallel to the transverse direction. The laminated element, along the connecting element axis, has a central section and two end sections. By this means a very simple connection and transfer of loads may be achieved between the end sections and the central section, the central section being linked to one of the connected components (motor or running gear frame) while the two end sections being linked to the other one of the two connected components.

Preferably, the central section has a substantially cylindrical shape to provide a readily available interface to the adjacent component. In addition or as an alternative, at least one of the end sections has a substantially conical shape. This is particularly beneficial in terms of the introduction of loads into the connecting element as well as the characteristic line of the transverse rigidity.

With the further preferred embodiments of the invention, the laminated element has a total length along the connecting element axis, while the central section has a first length along the connecting element axis, and an outer diameter and an inner diameter in a plane perpendicular to the connecting element axis. Finally, at least one of the end sections has a second length along the connecting element axis. Preferably, the first length is 35% to 65% of the total length, preferably 45% to 55% of the total length, more preferably substantially 50% of the total length. In addition or as an alternative, preferably, the second length is 15% to 35% of the total length, preferably 20% to 30% of the total length, more preferably substantially 25% of the total length. Furthermore, preferably, the outer diameter is 80% to 120% of the total length, preferably 90% to 110% of the total length, more preferably substantially 100% of the total length. Finally, preferably, the inner diameter is 30% to 50% of the total length, preferably 35% to 45% of the total length, more preferably substantially 40% of the total length. Any of these dimensional relations, either alone or in arbitrary combination, provides particularly beneficial designs with good decoupling properties.

The laminated element may have any desired suitable design. With preferred embodiments of the invention, the laminated element comprises at least seven layers, preferably at least eleven layers, more preferably 13 to 17 layers, thereby providing a good compromise between high radial rigidity, low transverse rigidity at considerable transverse excursions and excellent lifetime. In addition or as an alternative, the elastic layers are made of a rubber material. Furthermore, in addition or as an alternative, the substantially rigid layers are made of a metallic material, in particular steel.

With further preferred embodiments of the invention showing a very simple and reliable connection, and that is easy to produce, the connecting element comprises a centrally arranged axis element, the axis element (preferably at both of its ends) being connected to the running gear frame unit, while an outer circumference of the central section is connected to the motor unit. Such a configuration allows easy mounting and dismounting of the motor unit, e.g. by simply hooking the axis element of the connecting element premounted to the motor unit into a corresponding fork element or the like of the running gear frame unit.

It will be appreciated that the connecting device may comprise any desired number of connecting elements. In particular, even one single connecting element may be sufficient. Preferably, the connecting device comprises three connecting elements connected to the motor unit and the running gear frame unit. These connecting elements may be of a different design. However, preferably, the connecting elements are of substantially identical design.

Furthermore, any desired arrangement of the connecting elements in space may be chosen. Preferably, a first and a second one of the connecting elements, in the height direction, are located, preferably at substantially equal level, above a third one of the connecting elements. By this means a beneficial three-point support with an advantageous evenly distributed introduction of the support loads may be achieved. The same applies in, in addition or as an alternative, a third one of the connecting elements, in the transverse direction, is located, preferably substantially halfway, between a first and a second one of the connecting elements.

With further preferred embodiments of the invention a damping device, in particular a shock absorber, is provided, the damping device being connected to the motor unit and to the running gear frame unit and acting in the transverse direction. Such a damping device may be tuned to have a beneficial effect on the dynamic properties of the running gear. Preferably, the damping device defines a line of action, the line of action, in particular, being located, in the height direction, at a damper level which is at least close to, in particular substantially coincides with, a motor shaft level of the motor unit. This has a particularly beneficial effect on the distribution of loads within the system. In particular, it has a beneficial effect on the tooth engagement situation at the pinion of the motor shaft.

With further preferred embodiments of the invention, a hard stop device is provided, the hard stop device limiting the transverse relative motion between the motor unit and the running gear frame unit. Such a hard stop device, in a simple manner, by limiting the transverse relative motion prevents excessive stress due to excess deflection within the connecting device. Preferably, the hard stop device limits the transverse relative motion between the motor unit and the running gear frame unit from said transversally undeflected state to 5 mm to 20 mm, preferably to 8 mm to 12 mm, to each side (i.e. in each direction). Preferably, the hard stop device is spatially associated to a connecting element of the connecting device leading to a very simple design.

It will be appreciated that the present invention may be used in any desired running gear, for example in a single wheel unit running gear. However, the effects of the present invention are beneficial in running gears with a plurality of wheel units. Hence, preferably, a further wheel unit and an associated further motor unit driving the further wheel unit are provided, the further motor unit being connected to the running gear frame unit via a further connecting device. Preferably, the further connecting device is substantially identical to the connecting device as described above. Furthermore, the further connecting device preferably is arranged substantially symmetrically with respect to a centrally located height axis of the running gear frame unit.

It will be appreciated that the present invention may be used for any desired rail vehicle operating at any desired nominal operating speed. However, the beneficial effect of the present invention or a particularly visible in the high-speed operations. Hence, preferably, the running gear it is adapted for a nominal operating speed above 250 km/h, preferably above 300 km/h, more preferably above 350 km/h.

The present invention furthermore relates to a rail vehicle with a running gear according to the invention as it has been outlined above.

Further embodiments of the present invention will become apparent from the dependent claims and the following description of preferred embodiments which refers to the appended figures.

DETAILED DESCRIPTION OF THE INVENTION

Figure 1:
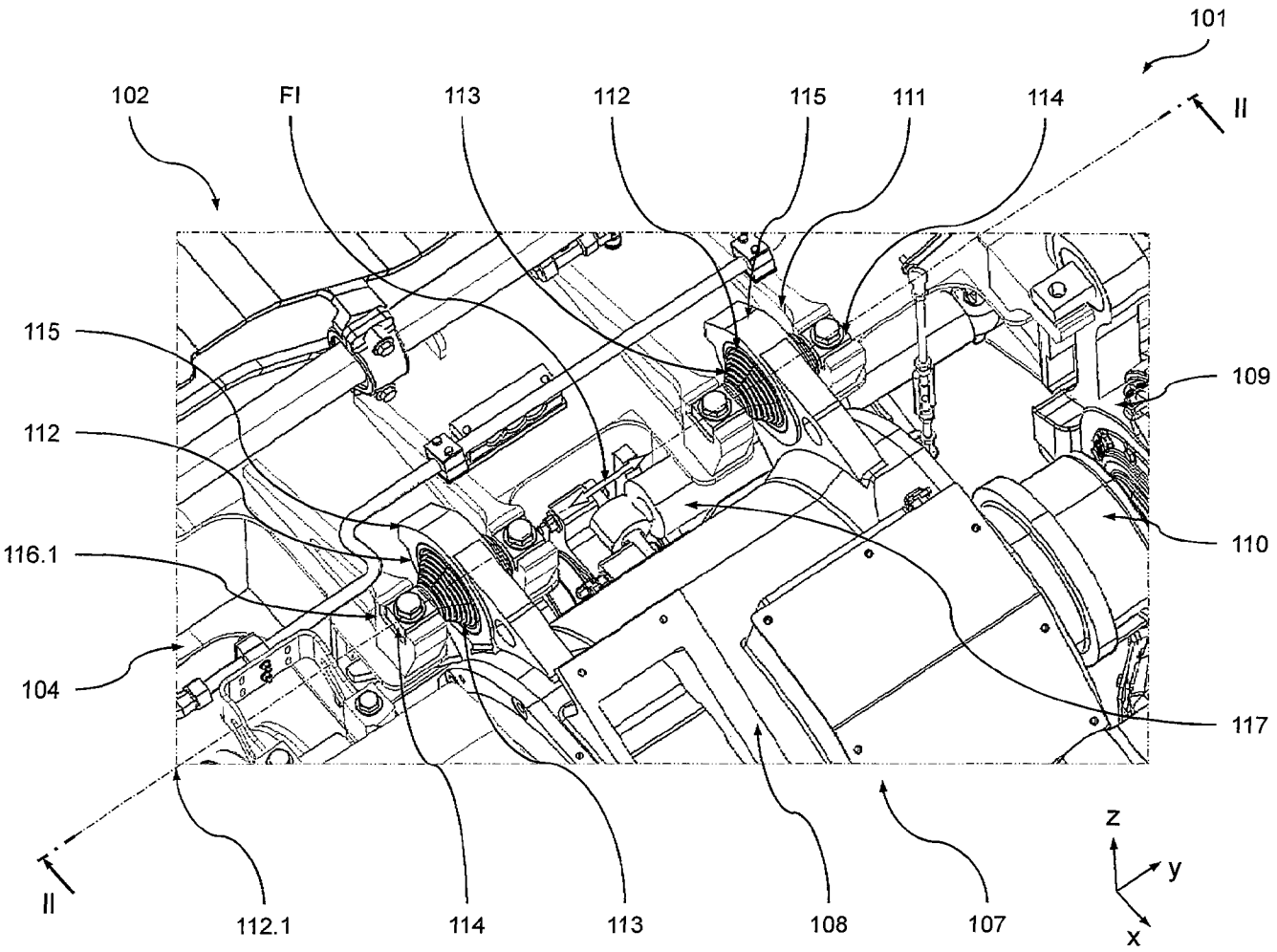
FIG. 1 is a schematic perspective top view of a preferred embodiment of a running gear according to the present invention used in a preferred embodiment of the vehicle according to the present invention.
Figure 2:
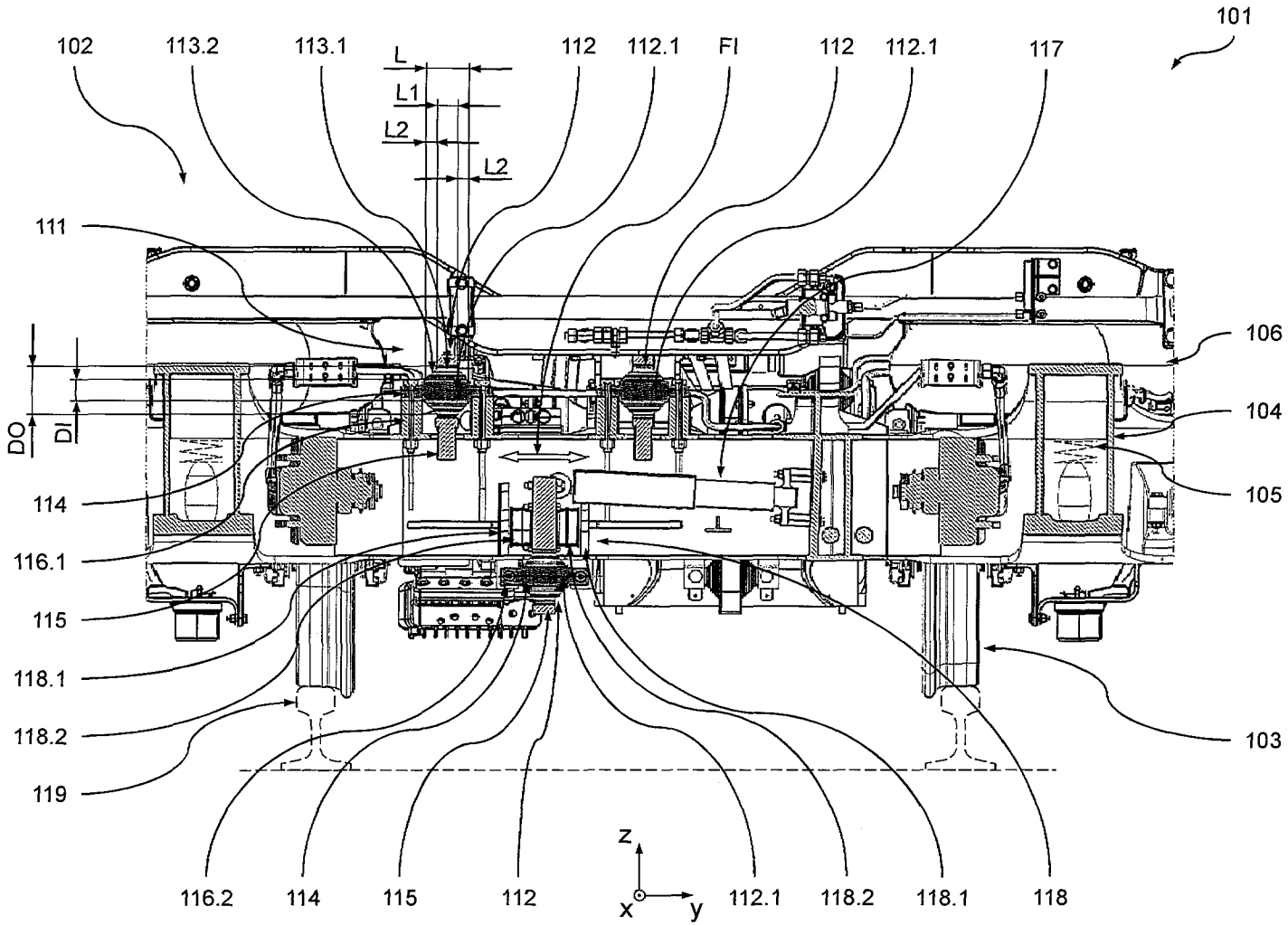
FIG. 2 is a schematic sectional representation of a detail of the running gear of FIG. 1 (along line II-II of FIG. 1).

With reference to FIGS. 1 and 2 a preferred embodiment of a rail vehicle 101 according to the present invention comprising a preferred embodiment of a running gear 102 according to the invention will now be described in greater detail. In order to simplify the explanations given below, an xyz-coordinate system has been introduced into the Figures, wherein (on a straight, level track) the x-axis designates the longitudinal direction of the running gear 102, the y-axis designates the transverse direction of the running gear 102 and the z-axis designates the height direction of the running gear 102.

The vehicle 101 is a high-speed rail vehicle with a nominal operating speed above 250 km/h, more precisely above 300 km/h to 380 km/h. The vehicle 101 comprises a wagon body (not shown) supported by a suspension system on the running gear 102. The running gear 102 comprises two wheel units in the form of wheel sets 103 supporting a running gear frame unit 104 via a primary spring unit (schematically indicated by the dashed contour 105 of FIG. 2). The running gear frame unit 104 supports the wagon body via a secondary spring unit 106.

Each wheel set 103 and is driven by a drive unit 107. The drive unit 107 comprises a motor unit 108 (suspended to the running gear frame unit 104) and a gearing 109 (sitting on the shaft of the wheel set 103) connected via a motor shaft 110. Both drive units 107 are of substantially identical design and arranged substantially symmetrically with respect to the center of the running gear frame unit 104. Hence, in the following, only one of the drive units 107 will be described in greater detail.

The running gear frame unit 104 is of generally H-shaped design with a middle section in the form of a transverse beam 104.1 located between the wheel sets 103. Each motor unit 108 is suspended to the transverse beam 104.1 via a connecting device 111 comprising three substantially identical connecting elements 112.

Each connecting element 112 defines a connecting element axis 112.1. In the height direction (z-direction) to upper connecting element axes 112.1 located above the center of gravity of the motor unit 108, while one lower connecting element axis 112.1 is located below the center of gravity of the motor unit 108. As can be seen, in particular from FIG. 2, the connecting element axes 112.1 of all three connecting elements 112 are parallel to the transverse direction (y-direction) and lie in a common transverse plane (xy-plane), the two upper connecting element axes 112.1, in addition, being collinear. Hence, a simple three-point support to the motor unit 108 is formed.

Each connecting element 112 comprises a laminated element 113 sitting on a centrally located axis element 114. The laminated element allows transverse relative motion, i.e. motion in the transverse direction (y-direction), between the motor unit 108 and the running gear frame unit 104. To this end, each laminated element 113 comprises a series of 15 layers forming an alternating sequence of elastic layers made of a rubber material and substantially rigid layers made of a steel material. The layers of the laminated element 113, in a transversally undeflected state (as shown in FIGS. 1 and 2), extend substantially parallel to the transverse direction.

Each laminated element 113, along the connecting element axis 112.1, has a cylindrical central section 113.1 and two conical end sections 113.2, a design which does not only provide a simple interface to the connected components but is also is beneficial in terms of the characteristic line of the transverse rigidity TR of the connecting element 112 as will be explained in greater detail below. The respective central section 113.1 is mounted in a bore of a lug 115 formed at the motor unit 108, while the two end sections 113.2 are linked to the running gear frame unit 104 via the free ends of the central axis element 114 (extending throughout and thoroughly contacting the entire inner circumference of the laminated element 113).

In the height direction, the position of the lugs 115 is selected such that distance of the respective connecting element axis 112.1 with respect to be center of gravity of the motor unit 108 is sufficiently high to provide proper support to the static and dynamic support forces introduced into the running gear frame unit 104 and resulting, among others, from the wake of the motor unit 108 and the drive torque transmitted.

As can be seen from FIGS. 1 and 2, the free ends of the axis elements 114 of the two upper connecting elements 112 are simply hooked from above into two fork shaped elements 116.1 mounted to the running gear frame unit 104. The free ends of the upper axis elements 114 are substantially rigidly fixed in place via fixing elements such as screws or the like. The free ends of the axis element 114 of the lower connecting element 112 simply abuts against corresponding counterpart surfaces 116.2 (extending in the xy-plane) which are formed at the running gear frame unit 104. Here as well, the free end of the axis element 114 are substantially rigidly fixed in place via fixing elements such as screws or the like.

As can be seen from FIG. 2, the laminated element 113 has a total length L along the connecting element axis 112.1. Its central section 113.1 has a first length L1 along the connecting element axis 112.1 an outer diameter DO and an inner diameter DI in a plane perpendicular to the connecting element axis 112.1. Furthermore, each end section 113.2 has a second length L2 along the connecting element axis 112.1.

In the embodiment shown, the first length L1 is substantially 50% of the total length L, while the second length L2 is substantially 25% of the total length L. Furthermore, the outer diameter DO is substantially 100% of the total length L, while the inner diameter is substantially 40% of the total length L.

The above design and material composition provides a laminated element 113 and, consequently, a connecting element 112 which is substantially rigid in its radial direction, i.e. has a comparatively high rigidity in its radial direction (i.e. in a plane perpendicular to the connecting element axis 112.1) while having a comparatively low rigidity in the transverse direction.

On the one hand, the high radial rigidity is beneficial in terms of the well-defined suspension of the motor unit 108 in a longitudinal plane (xz-plane) of the running gear 102. In particular, well-defined interfacing and tooth matching, respectively, of the gear wheels of the motor unit 108 and the gear unit 109 is simplified by this means.

On the other hand, the comparatively low rigidity in the transverse direction provides an improvement of the dynamic behavior of the running gear 102, in particular, at high speeds. This is due to the elastic decoupling between the motor unit 108 and the running gear frame unit 104 in the transverse direction provided by the low transverse rigidity TR of the connecting device 111 over a certain deflection in the transverse direction. As mentioned initially, this configuration has the advantage that, on the one hand, due to the suspension of the motor unit 108 to the running gear frame unit 104, the motor unit 108 forms part of the sprung mass. This provides all the dynamic and acoustic advantages of a reduced unsprung mass of the running gear 102.

Furthermore, this solution has the advantage that, over a certain transverse deflection, the mass of the motor unit 108, if at all noticeable, only contributes to the inertial moment of the running gear frame unit 104 to a highly reduced extent. This is highly beneficial in terms of the running stability of the running gear, especially at high speeds, which is considerably improved due to a low inertial moment about the running gear's yaw axis (i.e. the height axis of the running gear 102).

In the present example, the connecting device in 111 has a defined transverse rigidity TR which, in the transversally undeflected state, is sufficiently low such that, compared to a substantially transversally rigid mounting of the motor unit 108 to the running gear frame unit 104, a contribution of the motor unit 108 to an inertial moment of the running gear frame unit 104 about the height direction (z-axis) is reduced by 80% to 90%.

It will be appreciated that such a substantially transversally rigid mounting as mentioned above could, for example, be achieved if the connecting elements 112 were replaced by substantially rigid replacement connecting elements or reference connecting elements having the same dimensions but being made of solid steel or the like.

In the present example, the decoupling properties of the connecting elements 112 and, hence, of the connecting device 111, in particular, the characteristic line of the transverse rigidity TR of the connecting device 111, are adjusted as a function of the specific kinematics of the running gear 102, its mass distribution, in particular the mass of the motor unit 108, and the loads to be expected during normal operation of the running gear 102.

The amount of decoupling is chosen according to the dynamic requirements of the running gear 102 at its normal or nominal operating speed above 300 km/h, namely at 380 km/h. Hence, in the present example the transverse rigidity TR, in the transversally undeflected state, is that low that an inertial transverse force FI (schematically indicated in FIGS. 1 and 2) resulting from a given acceleration A of the motor unit 108 in the transverse direction and introduced via the connecting device 111 into the running gear frame unit 104 is about 10% to 20% of a reference transverse force FIR . The reference transverse force FIR is an inertial transverse force resulting, in a reference state, from the above given acceleration A of the motor unit 108 in the transverse direction and introduced via the reference connecting device into the running gear frame unit 104 as it has been outlined above.

To achieve the above values, in the present example with a mass of the motor unit 108 of MM=470 kg and a maximum transverse deflection of DTM=10 mm, the transverse rigidity TR of the connecting device 111, in the transversally undeflected state, is 0.20 kN/mm to 0.25 kN/mm, preferably TR=0.23 kN/mm.

It will be appreciated, however, that, with other embodiments of the invention, a different transverse rigidity TR may be chosen for the respective connecting device. In particular, the transverse rigidity TR may vary among some or even all of the connecting elements of the connecting device.

In the present example, the characteristic line of the transverse rigidity TR of the connecting device 111 is tuned to the specifics of the running gear 102. More precisely, in the present example, the decoupling effect decreases with increasing transverse deflection of the connecting device 111. In other words, the transverse rigidity TR, from the transversally undeflected state (as shown in FIGS. 1 and 2), follows a characteristic line progressively, rising with increasing deflection.

It will be appreciated that, in the present example, the transverse rigidity TR of the connecting device 111 is substantially independent from the frequency of the deflection of the connecting device 111. However, it will be appreciated that, with other embodiments of the invention, the transverse rigidity TR of the connecting device may vary as a function of the frequency of the loads acting and, hence, a function of the frequency of the transverse excursion or deflection occurring.

In particular, such a frequency dependent rigidity may be achieved using, for example, polymers showing a frequency dependent elasticity or rigidity, respectively, for the elastic layers of the laminated element of the connecting element. In these cases, preferably, the connecting device has a frequency dependent behavior, the transverse rigidity TR as outlined above being present at a frequency of the relative transverse motion above 1 Hz, preferably from 1 Hz to 15 Hz, more preferably from 3 Hz to 10 Hz.

In any case, also in the present example with the non-frequency dependent decoupling behavior, good transverse decoupling is achieved for comparatively small transverse deflections which is particularly beneficial at high operating speeds.

As can be seen from FIGS. 1 and 2, a damping device in the form of a damper or shock absorber 117 is mounted and acting between the lower lug 115 of the motor unit 108 and the running gear frame unit 104. The major component of action of the damper 117 lies in the transverse direction. Furthermore, the damper defines a line of action which is located, in the height direction, at a damper level which substantially coincides with the height level of the motor shaft 110 of the motor unit 108. This has a particularly beneficial effect on the distribution of loads within the system. In particular, it has a beneficial effect on the tooth engagement situation at the pinion of the motor shaft 110.

It will be appreciated that the damping properties of the damper 117 are tuned to have a beneficial effect on the dynamic properties of the running gear 102, in particular at the nominal operating speed. Furthermore, it will be appreciated that the damper 117 may also be used to adapt the overall transverse rigidity TRG of the mounting of the motor unit 108 to the running the frame unit 104 to give and desired behavior. In particular, a behavior dependent on variables and/or parameters of the system other than the mere transverse excursion (such as e.g. the frequency of the excursion) may be achieved via an appropriate design of the damping device 117.

As can be seen from FIG. 2, a hard stop device 118 in the form of two lateral hard stops 118.1 is provided. The hard stop device 118 limits the transverse relative motion between the motor unit 108 and the running gear frame unit 104 to prevent excessive stress due to excess deflection within the connecting device 111 due to the introduction of extreme dynamic disturbances as they may result, for example, from acute irregularities of the track 119 currently negotiated a. In the present example, transverse relative motion between the motor unit 108 and the running gear frame unit 104 from the transversally undeflected state (as shown in FIGS. 1 and 2) is limited to ±10 mm.

The hard stops 118.1 are spatially associated to shock absorbing pads 118.2 mounted to the lug 115 of the lower connecting element 112. This leads not only to a very simple design but also to a suitable introduction and support of the contact loads in such extreme events.

Although the present invention in the foregoing has only a described in the context of high-speed rail vehicles, it will be appreciated that it may also be applied to any other type of rail vehicle in order to overcome similar problems with respect to a simple solution for dynamic problems.

The invention claimed is:

1. A running gear for a rail vehicle, comprising a wheel unit, a motor unit and a running gear frame unit;

said running gear frame unit defining a longitudinal direction, a transverse direction and a height direction, and being supported on said wheel unit;

said motor unit being connected to said wheel unit to drive said wheel unit;

said motor unit being suspended to said running gear frame unit via a connecting device;

wherein said connecting device is transversally elastic to allow, from a transversally undeflected state of said connecting device, a relative transverse motion in said transverse direction between said motor unit and said running gear frame unit;

said connecting device having a transverse rigidity in said transverse direction, said transverse rigidity, in said transversally undeflected state, being sufficiently low such that, compared to a substantially transversally rigid mounting of said motor unit to said running gear frame unit, a contribution of said motor unit to an inertial moment of said running gear frame unit about said height direction is reduced by at least 50%.

2. The running gear according to claim 1, wherein said transverse rigidity, in said transversally undeflected state, is sufficiently low such that an inertial transverse force resulting from an acceleration of said motor unit in said transverse direction and introduced via said connecting device into said running gear frame unit is less than 50% of a reference transverse force;

said reference transverse force being an inertial transverse force resulting, in a reference state, from said acceleration of said motor unit in said transverse direction and introduced via a reference connecting device into said running gear frame unit; and said reference connecting device, in said reference state, replacing said connecting device and being substantially rigid to substantially prevent said relative transverse motion.

3. The running gear according to claim 1, wherein said transverse rigidity, in said transversally undeflected state, is less than 0.32 kN/mm;

and said transverse rigidity, from said transversally undeflected state, follows a characteristic line, said characteristic line rising with increasing deflection.

4. The running gear according to claim 1, wherein said connecting device has a frequency dependent behavior, said transverse rigidity being present at a frequency of said relative transverse motion above 1 Hz.

5. The running gear according to claim 1, wherein said connecting device comprises at least one connecting element;

said connecting element comprising a laminated element made from a sequence of elastic layers and substantially rigid layers, said layers, in said transversally undeflected state, extending substantially parallel to said transverse direction.

6. The running gear according to claim 5, wherein said connecting element defines a connecting element axis, said connecting element axis, in said transversally undeflected state, extending substantially parallel to said transverse direction;

said laminated element, along said connecting element axis, having a central section and two end sections;

said central section having a substantially cylindrical shape;

at least one of said end sections having a substantially conical shape.

7. The running gear according to claim 6, wherein said laminated element has a total length along said connecting element axis, said central section has a first length along said connecting element axis, and an outer diameter and an inner diameter in a plane perpendicular to said connecting element axis; and at least one of said end sections has a second length along said connecting element axis;

said first length being 35% to 65% of said total length;

and said second length being 15% to 35% of said total length;

and said outer diameter being 80% to 120% of said total length;

and said inner diameter being 30% to 50% of said total length.

8. The running gear according to claim 5, wherein said laminated element comprises at least seven layers, and said elastic layers are made of a rubber material;

and said substantially rigid layers are made of a metallic material.

9. The running gear according to claim 6, wherein said connecting element comprises a centrally arranged axis element; and said axis element being connected to said running gear frame unit, an outer circumference of said central section being connected to said motor unit.

10. The running gear according to claim 1, wherein said connecting device comprises three connecting elements connected to said motor unit and said running gear frame unit;

said connecting elements being of substantially identical design;

and a first and a second one of said connecting elements, in said height direction, being located above a third one of said connecting elements;

and a third one of said connecting elements, in said transverse direction, being located between a first and a second one of said connecting elements.

11. The running gear according to claim 1, wherein a damping device is provided;

said damping device being connected to said motor unit and to said running gear frame unit and acting in said transverse direction;

said damping device defining a line of action, said line of action being located, in said height direction, at a damper level which is at least close to a motor shaft level of said motor unit.

12. The running gear according to claim 1, wherein a hard stop device is provided;

said hard stop device limiting said transverse relative motion between said motor unit and said running gear frame unit from said transversally undeflected state to 5 mm to 20 mm to each side;

said hard stop device being spatially associated to a connecting element of said connecting device.

13. The running gear according to claim 1, wherein a further wheel unit and an associated further motor unit driving said further wheel unit are provided;

said further motor unit being connected to said running gear frame unit via a further connecting device;

said further connecting device being substantially identical to said connecting device is in;

and said further connecting device being arranged substantially symmetrically with respect to a centrally located height axis of said running gear frame unit.

14. The running gear according to claim 1, wherein the running gear is adapted for a nominal operating speed above 250 km/h.

15. A rail vehicle comprising a running gear according to claim 1.

* * * * *